United States Patent [19]

Shimatani et al.

[11] 4,270,484

[45] Jun. 2, 1981

[54] MACHINE FOR UNDERWATER PAINTING

[75] Inventors: Shirou Shimatani; Ryohji Orita, both of Tamano; Tsuneo Obokata, Tokyo, all of Japan

[73] Assignee: Mitsui Engineering & Shipbuilding Co., Ltd., Tokyo, Japan

[21] Appl. No.: 42,086

[22] Filed: May 24, 1979

[30] Foreign Application Priority Data

Oct. 7, 1978 [JP] Japan ..... 53-123987

[51] Int. Cl.[3] ..... B05B 15/04

[52] U.S. Cl. ..... 118/305; 15/1.7; 114/222; 118/64; 118/312; 118/313; 118/323; 427/421

[58] Field of Search ..... 118/64, 301, 305, 207, 118/108, 312, 313, 323; 15/1.7; 114/222; 427/421

[56] References Cited

U.S. PATENT DOCUMENTS

| | | | |
|---|---|---|---|
| 3,147,143 | 9/1964 | Kontani et al. | 118/108 X |
| 3,396,423 | 8/1968 | Hope | 114/222 X |
| 3,709,194 | 1/1973 | Hommelmann | 118/305 X |
| 3,777,834 | 12/1973 | Hiraoka et al. | 114/222 X |
| 3,859,948 | 1/1975 | Romano et al. | 15/1.7 X |
| 3,906,572 | 9/1975 | Winn | 15/1.7 |
| 3,960,229 | 6/1976 | Shio | 114/222 X |

FOREIGN PATENT DOCUMENTS

| | | | |
|---|---|---|---|
| 2400393 | 4/1979 | France | 118/305 |
| 52-111196 | 9/1977 | Japan . | |

*Primary Examiner*—Shrive P. Beck

*Attorney, Agent, or Firm*—Armstrong, Nikaido, Marmelstein & Kubovcik

[57] ABSTRACT

A method of automatic underwater painting over metal surfaces of ships and offshore constructions is disclosed, which broadly comprises the steps of freely running a painting machine along the metal surface, sealably attaching the machine onto the metal surface of a location as desired and thereby forming a painting chamber over the metal surface for painting, transferring the water within the painting chamber to a ballast tank of the machine, and while paint jetting nozzles of the machine being reciprocated within the painting chamber, jetting a paint to effect an even painting over a wide area of the metal surface. The painting machine, which is also disclosed, includes an improved maneuvering mechanism, improved buoyancy adjusting mechanism, improved waterproof electromagnet, nozzle driving mechanism and paint circulation system.

6 Claims, 17 Drawing Figures

FIG. 9
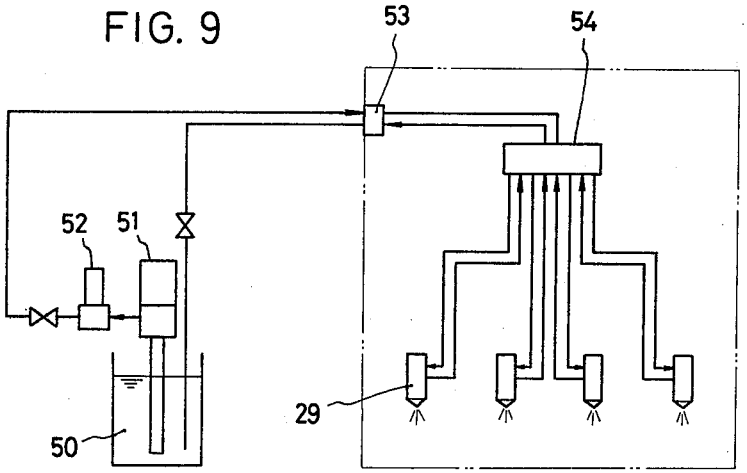
FIG. 10
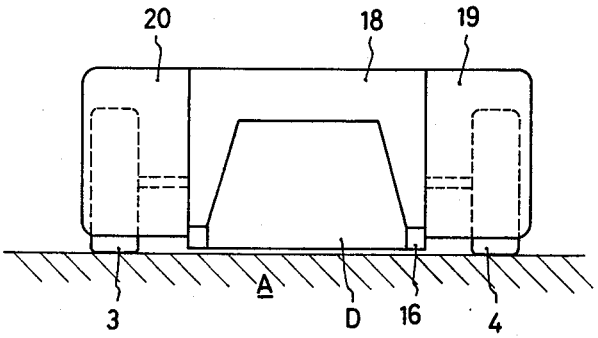
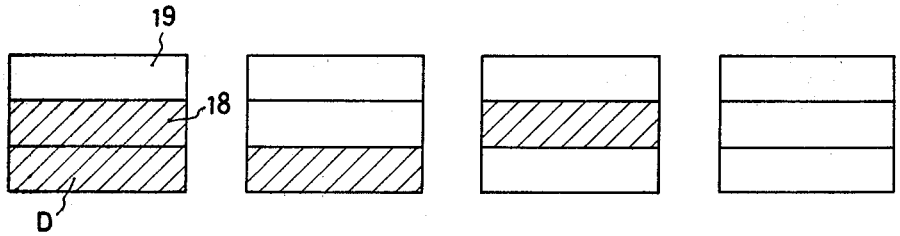
FIG.11(a) FIG.11(b) FIG.11(c) FIG.11(d)

MACHINE FOR UNDERWATER PAINTING

BACKGROUND OF THE INVENTION

The present invention generally relates to the field of underwater painting and, more particularly, an improved method of an apparatus for efficiently carrying out underwater painting of ships and offshore constructions.

In recent years, there has been a remarkable tendency seen to make ocean going ships more full in the hull scale as typically shown in the case of oil tankers. Also, it has become increasingly more frequent today than before to build an offshore construction such as an oil drilling rig or the like.

As such tendency develops, there have been increasing difficulties encountered. For example, with ships having a fuller hull size, a shortage is indicated of accordingly larger scale docks and docking accommodations. Additionally, the docking interval of ships has today been greatly prolonged in comparison to the past, and in accordance with this, various problems have now been presented concerning the mechanical maintenance of a submerged portion of the painted shell surface of the ship's hull. In the case of offshore constructions such as oil-well platforms for example, once it is towed to the prescribed sea area and settled thereat, the construction cannot with ease be towed or otherwise transferred for a maintenance operation. Thus, with an under water operation for the prevention of corrosion or rust generation, or for cleaning, maintenance and so forth are present. Thus, the necessity has now grown to be greater for efficiently carrying out underwater operation for the maintenance of ships and offshore constructions, and a solution effectively answering such necessity is universally called for today.

With regard to the art for underwater painting, there has not yet been an established technique. In some instances, underwater painting is worked by way of an manual operation done by divers manually coating an in-water curable paint, or it is effected by use of a spatula of the type in which the paint is fed under pressure. However, those operations are inefficient: They are only of a nature by which underwater painting can be done but no satisfactory painting performance can be obtained with regard to the thickness of the coated film, evenness of the coating and strength of the adhesion of paint (it is only $\frac{1}{3}$–$\frac{1}{4}$ of the strength in the case of a painting under atmospheric conditions).

In order to overcome the shortcomings of such old art, some underwater painting machines have been developed, an example of which is disclosed in Japanese Patent Application No. 51-26649 laid open under publication No. 52-111196 on Sept. 17, 1977. The painting machine of such prior art is as illustrated in FIG. 1 of the accompanying drawings, and in brief it has the following features:

The underwater painting machine includes a main body as indicated at 101 in FIG. 1, which has driving wheels 102 for driving the machine in back and forth or longitudinal directions and similar wheels 103 for driving in left and right or transverse directions, each wheel comprising an inflatable material such as a rubber type. By inflating the tyres by sending air into the same, the machine is lifted up, and by actuating an air motor or electric motor 104 and supplying power across an electromagnet 105 and 106, the machine can be driven to run in longitudinal and transverse directions without being detached from a surface of a construction to be painted. The main body 101 includes electromagnets 105 and 106 for preventing the machine from falling or floating away the surface for painting and a water valve 107. Within the body 101, further, an open-bottom box structure 108 is provided, internally defining a painting chamber 110, and between the body 101 and the box structure 108, there is formed a buoyancy tank 109. The box structure 108 has at its top a portion 111 for mounting thereto nozzles for injection of washing water for cleaning the surface for painting, air to be supplied at a high velocity for drying the washed surface and an in-water curable or hydro-curable paint. About the lower end periphery of the box structure 108, an inflatable sealing tube 112 and an outer covering 113 are extended, and by supplying air into the sealing tube 112 to have it inflated, the painting chamber 110 can be sealably shut from the ambient water. When the box structure 108 is thus intimately attached to the surface for painting, air will be sent into the painting chamber 110 through a flexible tube 114 to remove away the water within the chamber 110, and then the paint will be jetted through the nozzles fixed to the portion 111 to thereby paint the surface for painting.

The method of underwater painting utilizing an automatic painting apparatus as above described is more efficient in comparison to the manual painting operation of the old art. However, even such method has shortcomings for example as follows:

1. The painting machine is maneuvable only in longitudinal and transverse directions, whereby it is difficult to freely turn the machine or move it as desired.
2. The magnetic force of electromagnets is relatively low and the attenuation of magnetic force proportional to increase in distance is of a relatively high degree, so that particularly when there lies a relatively great distance between the electromagnets and the metal surface for painting, it is difficult to freely run the machine.
3. The machine is not adapted for changes in the buoyancy it receives when water is filled in the painting chamber or discharged from the same, and it is therefore difficult to maintain the machine in a stably settled condition in water.
4. The jetting nozzles are immovably secured at the top of the painting chamber, so that it is difficult to perform a uniform painting or to provide a relatively wide space for the painting chamber.
5. During the stoppage of painting operation, paint is permitted to stay in the piping, and the pipe is often permitted to undergo clogging.
6. The buoyancy adjusting mechanism limitedly comprises a buoyancy tank only, so that it is difficult to freely let the machine be submerged, floated or maintained in a stably settled condition.

BRIEF SUMMARY OF THE INVENTION

The present invention has overcome these and other shortcomings and difficulties with the existing underwater painting method and machine by providing an improved machine.

In using the present invention, an underwater painting machine is maneuvered in a wider range of direction than before and is run to any location on the painting surface as desired. Also, making use of the function of an annular sealing tube and a special or improved underwater electromagnet, a painting box structure is completely sealably attached onto a metal surface to be painted, thereby forming a sealed painting chamber. Then, the water received within the painting chamber is completely transferred to a ballast tank, and with paint jetting nozzles reciprocated within the painting chamber, painting is operated evenly over a relatively wide area of the metal surface for painting.

The present invention provides an automatic underwater painting apparatus or an underwater painting machine, which includes pneumatic-type wheels, an annular sealing tube and a painting box structure or chamber provided with paint jetting nozzles, and which further includes a machine maneuvering mechanism, special underwater electromagnets, a ballast tank and a mechanism for driving paint jetting nozzles for reciprocal motion.

Thus, a primary object of the present invention is to provide an improved apparatus for underwater painting.

Also, it is within the objects of the present invention to provide an improved underwater painting machine for the practice of painting, in which the painting machine can be substantially freely submerged, floated, run and maintained in a stable staying condition and can have a relatively wide space for the painting chamber thereof to enable an even painting performance.

These and other objects, features and advantages of the present invention will become clearly apparent as the specification proceeds to describe the invention with reference to the specific embodiment thereof illustrated in the accompanying drawings.

BRIEF DESCRIPTION OF THE DRAWINGS

FIG. 9 is a diagramatic view, showing a system for the circulation of paint in the underwater painting machine of FIG. 2;

FIG. 10 is a front elevation, showing the position of a buoyancy adjusting mechanism of the underwater painting machine of the present invention shown in FIG. 2; and FIGS. 11(*a*) through 11(*d*) are views taken for illustration of the operational feature of the buoyancy adjusting mechanism of FIG. 10.

DETAILED DESCRIPTION OF THE PREFERRED EMBODIMENT

Figure 1:
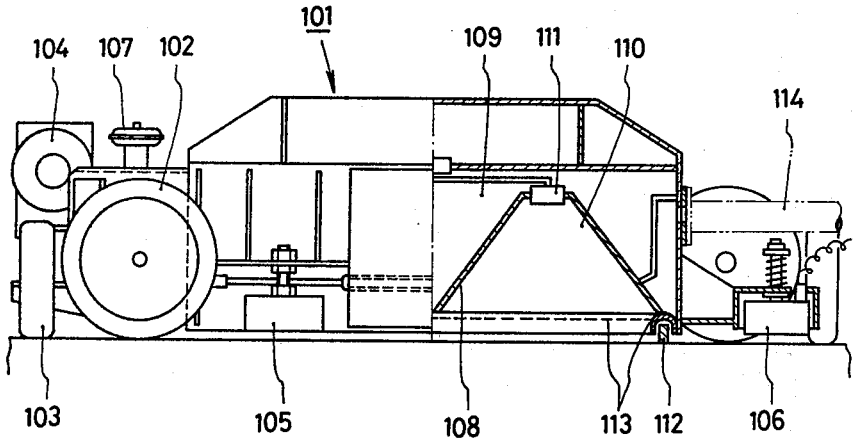
FIG. 1 PRIOR ART
FIG. 1 shows a partly exploded side elevational view of a conventional underwater painting machine.
Figure 2:
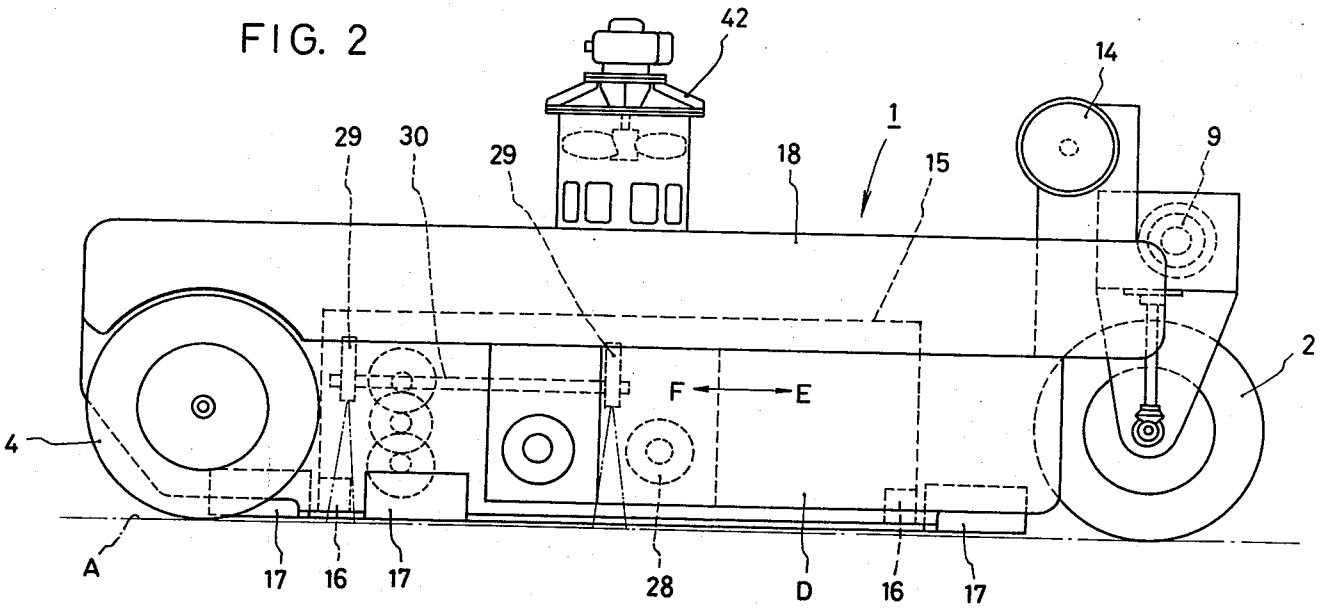
FIG. 2 is a side elevational view of an underwater painting machine according to the present invention.
Figure 3:
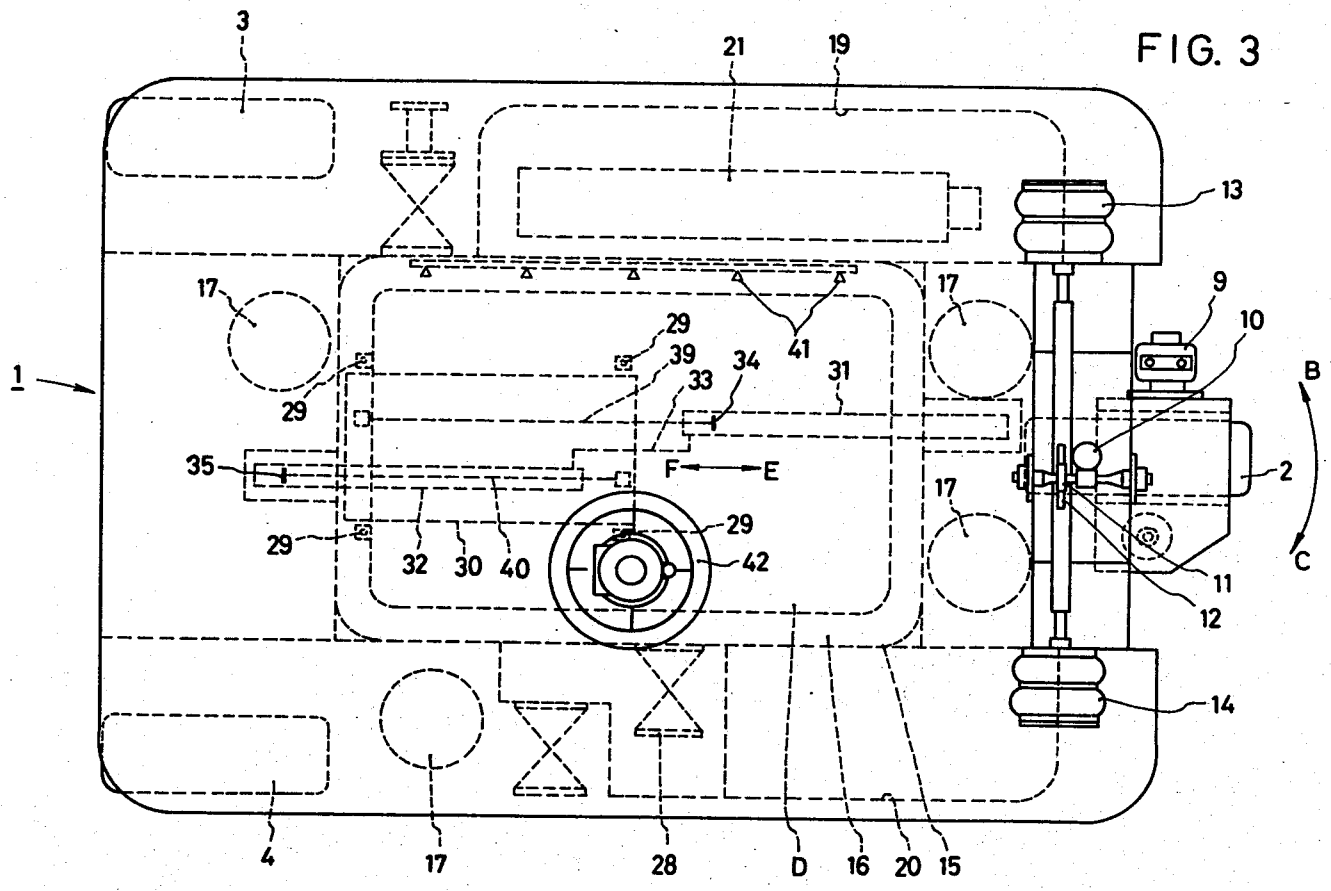
FIG. 3 is a top plan view of the machine of FIG. 2.

Referring now to the accompanying drawings and FIGS. 2 and 3 thereof initially, the underwater painting machine according to the present invention has a main body as therein generically indicated at 1, which has at its one longitudinal end (right side end in FIGS. 1 and 2) a driving wheel 2 disposed at a central portion in the widthwise direction of the main body 1 and at its other longitudinal end a pair of follower wheels 3 and 4 respectively disposed at a side end of the main body. Wheels 2, 3 and 4 individually have a tire portion composed of an inflatable material such as a rubber-made pneumatic tire for example, and are driven on a surface A to be painted of for example a metal plate forming the shell of a ship, off-shore construction or the like.

Figure 4:
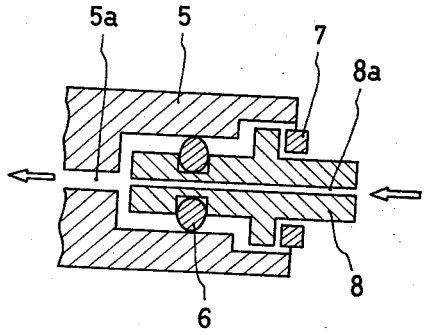
FIG. 4 is a partial sectional view, showing a mechanism for charging and discharging air into and from pneumatic tire wheels of the machine of FIG. 2.

As shown in enlargement in FIG. 4, the inflation degree of the tire of each wheel may be suitably adjusted by supplying or discharging air through the wheel shaft 5 or, more specifically, an air duct 5*a* formed through the shaft, which is in air communication with a similar duct 8*a* provided through a rotation seal 8 mounted at an end portion of the shaft 5 in an airtight and waterproof manner through an O-ring 6 and a stopper member 7.

Figure 8:
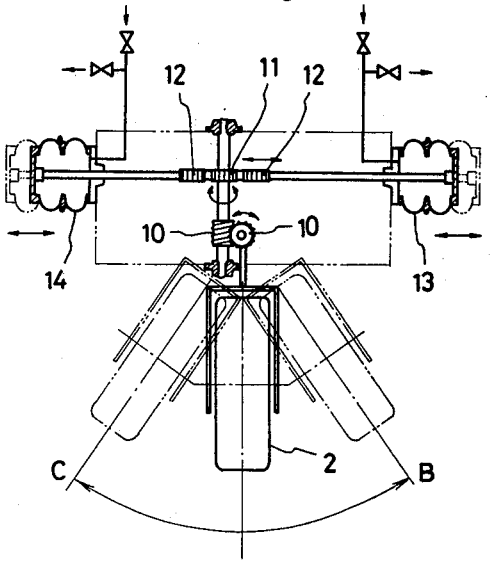
FIG. 8 is a plan view of a maneuvering mechanism of the painting machine of FIG. 2.

The driving wheel 2 is driven for rotation through an air motor or electric motor 9 (FIGS. 2 and 3), and is relatively freely maneuvered through a machine maneuvering mechanism as illustrated in FIG. 8.

In FIG. 8, with the wheel 2 a worm gear 10 is coupled, which is connected through a pinion gear 11 and rack 12 to air cylinders 13 and 14. Air may be sent to or discharged from the cylinders 13 and 14 to let the worm gear rotate, whereby the wheel 2 can be maneuvered in the directions of arrows B and C freely within a certain angular range limitation, which in the illustrated embodiment is 35°.

As best seen in FIGS. 2 and 3, the main body 1 has in its central portion an open-bottom box structure 15 providing for a painting chamber D. Along the lower end periphery of the side walls of the box structure 15 about which the box structure intimately contacts the surface A for painting, a sealing tube 16 is extended. By inflating the tube 16 with air and actuating an electromagnet as later to be described, the painting machine may be sealably attached onto surface A to be painted in a manner such that the tube 16 can contact the surface A in airtight and waterproof manner by its own inflation and the attraction of the electromagnet, whereby the interior of the painting chamber D is shut from the ambient water and/or air. In this connection, whereas pressure is evenly applied throughout the length of the inflatable tube 16 so as to prevent any local leakage of water from occuring, as the pressure in the tube is raised, the tube surface becomes less flexible due to rise of tension, and it may be devised to apply an outer covering such as foam rubber of a suitable hardness over the tube to thereby liberate the tension and cope with any irregularity in the condition of the surface A of a steel or metal plate.

At suitable positions outside of the box structure 15, an appropriate number of special waterproof electromagnets 17 may be securely mounted on the underwater painting machine of the present invention so that by the attraction of the magnets the machine can be sealably seated on the surface A requiring painting.

Figure 7:
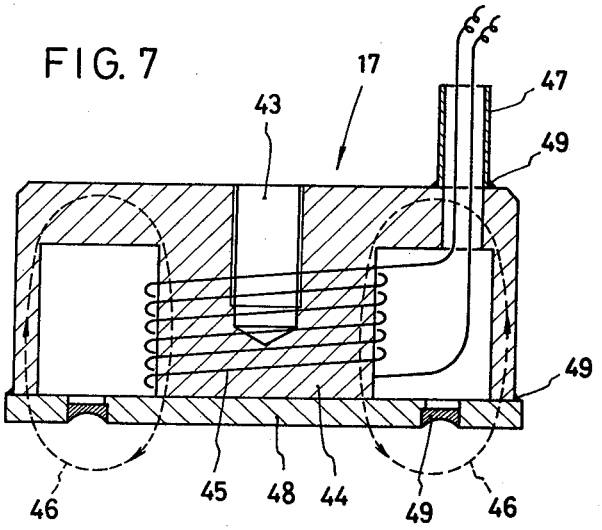
FIG. 7 shows a section of an improved special electromagnet of a waterproof structure, incorporated in the underwater painting machine of the present invention shown in FIG. 2.

The underwater electromagnet 17, which is special one according to the present invention, has a structure as shown in FIG. 7 for example and broadly comprises an iron core 44 having a bolt hole 43 and a coil 45 wound about the iron core. Across the coil alternate current may be directed to let the magnet 17 generate magnetic force 46. The contact surfaces of a terminal box 47 and the iron core 44 and those of magnet plate 48 and the iron core 44 have welded portions 49. The special or improved electromagnet 17 of the present invention thus comprises a hermetically sealed structure, and it can therefore be of a complete waterproof type with the coil 45 kept free of a contact with water and can be highly efficient. With the electromagnet 17 of the invention, further, the coil 45 is made of a relatively thick wire and the number of windings is relatively low. When so made, the electromagnet can have a characteristic that even although the magnetic force it can generate is relatively limited, the depth of the magnetic field can be relatively great. That is to say, with the electromagnet 17 of the present invention, although the power of attraction thereof may be more or less limited, the attenuation of magnetic force proportional to the distance between the magnet 17 and the surface A for painting can be effectively suppressed, whereby not only the painting machine can be stably seated on the painting surface A but also it is feasible to there maintain a relatively great distance from the surface A in letting the machine run along the same and let the machine run highly smoothly even in case of concave and convex irregularities in the surface A.

As schematically illustrated in FIG. 10, above the open-bottom box structure 15 and in a manner covering the painting chamber D, there is provided a ballast tank 18 (FIG. 1), which has a same capacity as the painting chamber D, and at the sides of the ballast tank 18, there are formed buoyancy tanks 19 and 20. In operation of the painting machine, by means of these buoyancy tanks, balancing is effected between the weight of the painting machine and the buoyancy it will receive: The total weight of the machine and the displacement and buoyancy of the ballast tank 18 and buoyancy tanks 19 and 20 are balanced to each other. Further, within the buoyancy tank 19, a heating device 21 is housed (FIG. 3), and the buoyancy tanks 19 and 20 may contain various metering devices (not shown) housed therein.

FIGS. 11(*a*) through 11(*d*) are taken for an explanation of the operation and function of the buoyancy adjusting mechanism described above in conjunction with FIG. 10, and for ease and convenience of illustration, the buoyancy tank 19, ballast tank 18 and painting chamber D are depicted respectively at the top, middle and bottom in the respective figures of the drawing in reference. Initially in FIG. 11(*a*), the ballast tank 18 and painting chamber D are filled with water or sea water, and the painting machine is in a submerged condition. FIG. 11(*b*) represents a condition in which the sea water has been discharged out of the ballast tank, when the painting machine is in a condition of being driven to run. FIG. 11(*c*) denotes a condition in which the water originally in the painting chamber has now been transferred into the ballast tank 18, when painting operation can be worked. In the condition illustrated in FIG. 11(*d*) the water received within the ballast tank 18 in FIG. 11(*c*) has now been discharged and the painting machine is or is being floated up.

Figure 6:
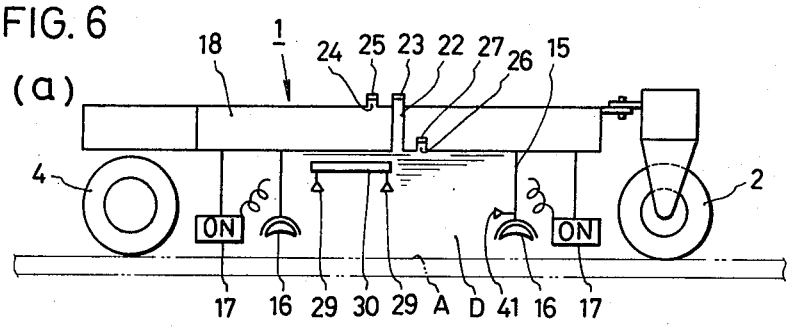
FIGS. 6(*a*) through 6(*d*) are views taken for illustration of various steps during the operation of the painting machine of FIG. 2.
Figure 6:
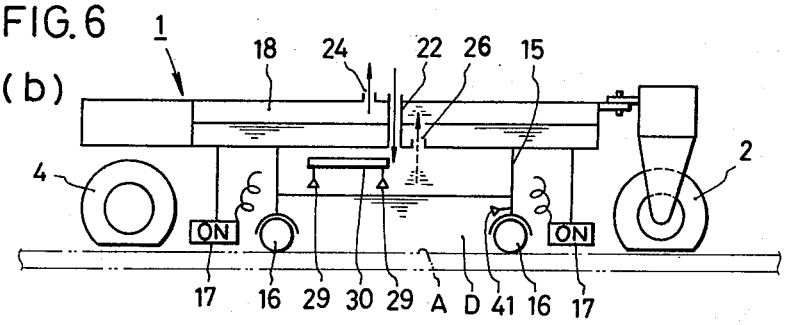
Figure 6:
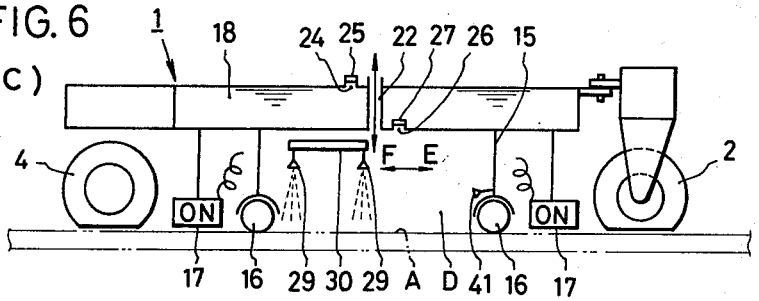
Figure 6:
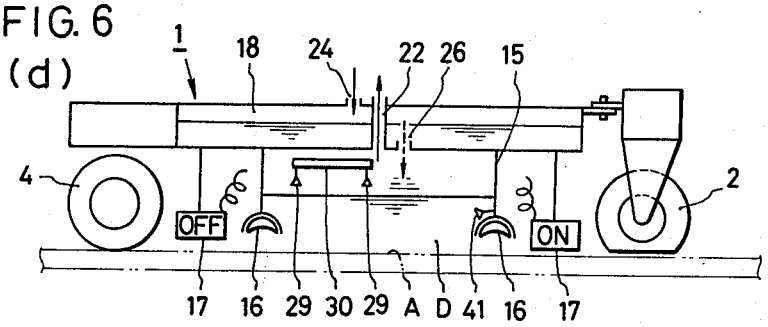

As illustrated in FIG. 6, air can be supplied into or discharged from the painting chamber D through a duct 22 provided with a valve 23. Similarly, the ballast tank 18 has an air opening 24 provided with a valve 25, through which air can be charged or discharged. Further, the chamber D and the tank 18 communicate with each other through a communication opening 26 provided with a valve 27, and by suitably operating the valve 27 it is feasible to transfer the water or ballast water in either the chamber D or the tank 18 into the other. Moreover, a draining pit valve 28 (FIG. 3) is provided in the main body 1 of the underwater painting machine of the invention, facilitating a rapid discharge of water from the ballast tank 18 and buoyancy tanks 19 and 20.

Figure 5:
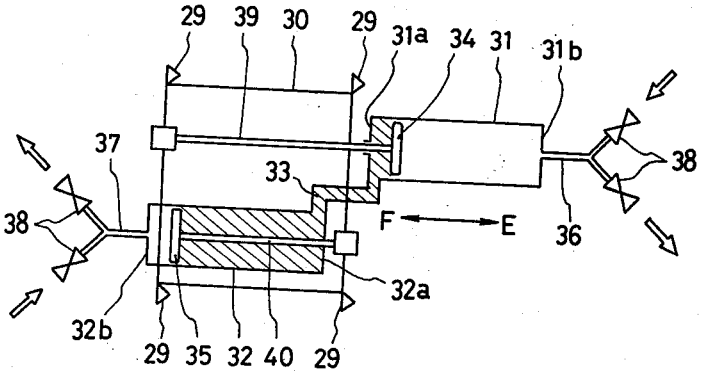
FIG. 5 is a plan view of a driving mechanism for paint injection nozzles of the painting machine of FIG. 2.

Then, in FIGS. 2, 3 and 5, a plurality of paint jetting nozzles 29 are mounted on a frame 30, which is driven by air cylinders 31 and 32 for reciprocation in the directions of E and F within the painting chamber D. As best seen in FIG. 5, cylinders 31 and 32 are connected through a pipe 33 disposed between the confronted side ends 31*a* and 32*a* respectively of the cylinders 31 and 32. In a half portion of the cylinder 31 defined between the side end 31*a* and the head 34 of a piston associated with the cylinder and that of cylinder 32 defined between the side end 32*a* and the head 35 of the associated piston, as well as in the cylinder-connecting pipe 33, a fluid such as oil is filled. To the other side ends 31*b* and 32*b* respectively of air cylinder 31 and 32, air pipes 36 and 37 are respectively provided, which are connected to a valve 38, and through the valve 38 and pipes 36 and 37 air is supplied into or discharged from the other half portions of cylinders 31 and 32. To the frame 30 having nozzles 29 mounted at its four corner portions, fixed are the ends of rods 39 and 40, opposite of the heads 34 and 35, of pistons associated with cylinders 31 and 32 respectively. Through a valve synchronized in operation with the operation of pistons or piston heads 34 and 35, the jetting pressure and amount of paint may be suitably controlled.

Thus, air may be supplied into or discharged from air cylinders 31 and 32 to contemporaneously drive pistons 34 and 35, and at the same time, the flow rate of oil through the cylinder-connecting pipe 33 may be suitably controlled, to freely adjust the velocity of reciprocation of the frame 30 and accordingly the pressure and amount of paint to be jetted or the velocity of painting. Whereas the paint injection nozzle 29 may be operated according to an air-spray system or an airless-spray system, it is preferred in this connection to provide a system for circulating the paint so as to effectively prevent nozzles from occurring that the nozzle would undergo clogging due to the presence of a foreign matter in paint or coagulation of paint.

Illustrated in FIG. 9 is a preferred paint circulation system according to the present invention, and in the illustrated system the paint 50 stored in a paint tank is delivered by the function of a pressure pump 51 through a filter 52, a terminal 53 of the main body of the underwater painting machine and a manifold 54 to the four nozzles 29. Whereas the paint thus delivered is jetted through each nozzle 29, an excess portion of the paint, if any, may be sent back to the paint tank so as to be recycled. According to this paint circulation system, the paint is caused to repeat passage through the filter 52, whereby pipes and nozzles can be effectively prevented from clogging.

For paint to be applied for the prevention of rust and/or corrosion in accordance with the present invention, an in-water curable or hydro-curable paint may be preferably employed, which can dispense with a drying operation after painting and can be exposed to contact with water immediately after painting and with which the time can therefore be shortened for the operation of introducing water into the painting chamber D after painting.

As shown in FIG. 3, further, in the painting chamber D there are provided injector nozzle 41 and valves (not shown) for applying water and air onto the surface A for washing and drying the same.

Also, as shown in FIGS. 2 and 3, the main body 1 of the underwater painting machine of the present invention is provided with a thruster 42 of the type having a screw driven by an air motor. With this thruster 42, the screw may be rotated to obtain propulsive force applied by fluid outside of the painting machine and provide force of attraction so as to assist in letting the machine be seated onto the surface for painting A or preventing the machine from becoming accidentally abruptly detached from about such surface portion.

The underwater painting machine of the present invention may be put for operation according to the following manners:

Initially in FIG. 6(*a*), air may be exhausted from the sealing tube 16 surrounding the lower periphery of the open-bottom box structure 15 and, as soon as inflatable tires of the driving wheel 2 and follower wheels 3 and 4 are suitably inflated with air sent thereinto, power will be supplied across the electromagnet 17, whereby the main body 1 of the painting machine can be attracted towards the surface A comprising for example a shell steel plate of a ship's hull in a manner of the sealing tube 16 not contacting the surface A as shown. Then, while operating the thruster 41, the wheel 2 may be driven by motor 9 and maneuvered through the function of air cylinders 13 and 14 in the directions of B and C (FIG. 1) to bring the painting machine to the prescribed location for painting operation. Thereafter, removal of air will be operated of the tyres of wheels 2, 3 and 4, whereby the main body 1 can now be attracted by the function of electromagnet 17 and become fastened onto the surface for painting A and whereby the positioning of the painting machine can be accomplished.

Then, the sealing tube 16 may be inflated by sending air thereinto, and it can sealably contact the surface A on account of the force of its expansion, attaching action of the outer covering and the attraction of the electromagnet 17, whereby the painting chamber D can be seated and shut from its surrounding environment in an airtight and water-proofed manner as shown in FIG. 6(*b*). When such condition is met, air will then be sent into the painting chamber D through duct 22 and the valve 27 of the communication opening 26 will be opened to exhaust air from the ballast tank 18, whereby the water in the painting chamber D can be transferred by the pressure of air within the chamber into the ballast tank 18. Although not specifically illustrated in FIGS. 6(*a*) to 6(*d*), the opening 26 is connected to a pipe extending closely to the plane of the open bottom of the chamber D so that the water within the chamber can be wholly transferred into the ballast tank 18.

When the water or sea water is substantially completely removed from the painting chamber D, the interior of the chamber D will be communicated with the atmosphere through a flexible tube connected to the valve 23 and, if necessary, washing water may be jetted through the injector nozzles 41 to wash the surface A in preparation for painting and, subsequent to the washing, drying of the surface A may be operated by heated air sent at a high velocity.

Further, as shown in FIG. 6(*c*) an in-water curable paint may be applied by jetting through nozzles 29 while the frame 30 being driven to reciprocate within the chamber D by way of supplying air into and discharging it from cylinders 31 and 32, whereby the predetermined portion of the surface A can be wholly painted.

Upon completion of the painting (a paint drying operation can be dispensed with as before mentioned), ballast water within the tank 18 will be transferred into the painting chamber D through the valve 27 and opening 26, and while it is being done, power supply may be stopped across the electromagnet 17 of either side, for example the left side in FIG. 6(*d*) and, at the sametime, air will be sent into the tire of for example wheels 3 and 4 in this case, whereby the painting machine can take an inclined position as shown in FIG. 6(*d*). Subsequently, power may again be supplied across the above electromagnet 17 to there generate a condition of suction or attraction, and same steps as above may then be operated in connection with the electromagnet 17 of the other side and the driving wheel 2, whereby a full introduction of water into painting chamber D can be again made. When all wheels 2, 3 and 4 are thus suitably inflated with respect to their tires, the painting machine will be ready to run along the surface A as attracted thereto by the function of electromagnets 17 and be brought to a next location for painting. In this connection, it is required that before such condition is met with the painting machine, the sea water within the ballast tank 18 be completely discharged into the painting chamber D and also the sealable contact be preparatively liberated between the surface A and the sealing tube 16 by exhausting air from the tube.

By repeating the above steps, it is feasible to paint the surface A successively from one point thereon to others.

During the above operation, the thruster 41 may be operated to there obtain force of attraction in addition to that by the function of electromagnets 17 and, in the case of stoppage of power supply across electromagnets, maintain the painting machine in position relative to the surface A so that it cannot accidentally fall or float, departing from the surface A.

The underwater painting machine according to the present invention, which has the foregoing structural and operational features, can bring about the following outlined advanges:

1. Whereas with the conventional underwater painting apparatus the maneuverability thereof is limited only to back and forth directions and towards left and right, the machine of the invention has a free maneuvering mechanism and can be maneuvered in a by far wider range of directions, so that it can be driven to run to any desired point on the surface for painting through a complex path which the prior art apparatus cannot follow.
2. In the machine of the invention, an improved special waterproof electromagnet is employed, of which the depth of the magnetic field is relatively great and the attenuation of magnetic force proportional to increase in distance is relatively suppressed, and attributable to this, a strong force of attraction is provided even in the case of the electromagnet not directly contacting a metal surface, whereby the machine can be driven to run along a metal surface of any inclination.
3. The machine of the invention is so structured as to have a ballast tank of the same capacity as the painting chamber, so that adjustment of the buoyancy can be made with ease and the machine can be smoothly driven for submerging, running and floating.

4. In the machine of the invention, paint jetting nozzles are connected to pistons and driven for reciprocation within the painting chamber, so that it is feasible with the machine to evenly paint a wide area of the surface for painting; in addition, the paint is circulated through piping to undergo filtration in repetition, so that clogging of pipes and nozzles can be effectively checked.

5. The machine of the invention is provided with a thruster, whereby the running and floating of the machine is greatly facilitated and also the stability in the attracted and fixed condition of the machine is greatly enhanced with the likelihood cancelled of the machine becoming unintentionally detached from the contacting surface to fall.

What is claimed is:

1. In a machine for underwater painting of a metal surface of ships and offshore constructions which includes a frame, an open bottom painting chamber connected to the frame, pneumatic tire wheels on the frame operatively supporting the frame, an annular inflatable sealing tube surrounding the periphery of the open bottom of the painting chamber, electromagnets disposed on the frame about the painting chamber, one buoyancy tank fitted to the frame, and paint jetting nozzles disposed within the painting chamber, the improvement of the machine further comprising a further buoyancy tank symmetrically disposed on the frame on an opposite side from the one buoyancy tank, a ballast tank centrally disposed on the frame, means for maneuvering at least one of the wheels through a limited angular range, and means for moving the paint jetting nozzles around in the painting chamber; and wherein the electromagnets each comprise an iron core, a coil wound about said iron core, a bolting hole in said iron core for affixing said electromagnet to the frame, and a magnet plate welded to said iron core hermetically sealing said coil in said core whereby the depth of the magnetic field is relatively great and the attenuation of magnetic force to increase in the distance from the metal surface is relatively low.

2. The improvement of claim 1 further comprising a thruster fixed to the frame for supplying additional force for holding the machine against the metal surface.

3. The improvement of claim 1 wherein the volume of said ballast tank is approximately equal to that of the painting chamber.

4. The improvement of claim 1 further comprising cleaning water injector nozzles disposed in the painting chamber.

5. The improvement of claim 1 wherein said means for moving the paint jetting nozzles comprises a further frame upon which the painting nozzles are fixed and means for reciprocating said further frame back and forth across the painting chamber attached to said further frame and the painting chamber.

6. The improvement of claim 5 wherein said means for reciprocating comprises a pair of cylinders attached to opposite sides of the painting chamber, a piston in each of said cylinders, each piston having a head side and a rod side, thereby defining in each cylinder a head chamber and a rod chamber, a pair of rods, each connected at one end to one of said pistons and at the other to said further frame, means for controlling air flow into and out of said head chambers, means for connecting said rod chambers, oil in said rod chambers and said means for connecting and means for controlling oil flow in said means for connecting.

* * * * *